US005899571A

United States Patent [19]

Chalk

[11] Patent Number: 5,899,571

[45] Date of Patent: May 4, 1999

[54] BEACH TOWEL, TOTE BAG AND BEACH UMBRELLA SYSTEM

[76] Inventor: Damon T. Chalk, 3206 Dilray Dr., Tampa, Fla. 33619

[21] Appl. No.: 08/783,260

[22] Filed: Jan. 15, 1997

[51] Int. Cl.[6] ..... B65D 30/00

[52] U.S. Cl. ..... 383/4; 383/75; 135/96; 135/98; 135/106; 135/16; 5/418

[58] Field of Search ..... 383/4, 75; 5/417, 5/418; 135/95, 96, 98, 15.1, 16, 106

[56] References Cited

U.S. PATENT DOCUMENTS

| | | | |
|---|---|---|---|
| 2,070,484 | 2/1937 | Jones | 383/4 X |
| 2,135,419 | 11/1938 | Wesseler | 383/4 X |
| 4,499,133 | 2/1985 | Prince | 383/4 X |
| 5,059,463 | 10/1991 | Peters . | |
| 5,195,828 | 3/1993 | Bush-Rodriguez . | |
| 5,207,508 | 5/1993 | Koutsis, Jr. | 383/4 |
| 5,217,034 | 6/1993 | Yih et al. | 135/90 X |
| 5,347,667 | 9/1994 | Schwarz et al. | 5/418 |
| 5,429,541 | 7/1995 | Landon . | |
| 5,482,374 | 1/1996 | Buhyoff . | |
| 5,515,564 | 5/1996 | Lyons | 383/4 X |

*Primary Examiner*—Jes F. Pascua

*Attorney, Agent, or Firm*—Joseph N. Breaux

[57] ABSTRACT

A combination beach towel, tote bag and beach umbrella system including a towel member, an umbrella member and an umbrella support. The towel member has a towel perimeter edge defining a towel shape, a drawstring sleeve provided adjacent to the towel perimeter, and a draw string having a first and second drawstring end positioned through the drawstring sleeve with the first and second drawstring ends extending out from the drawstring sleeve. The umbrella member has an umbrella perimeter defining an umbrella shape corresponding to the towel shape in a manner such that the umbrella perimeter and the towel perimeter can be placed in registration and four elongated, tubular shaped, fabric, pole attachment sleeves open at both ends thereof, each pole attachment sleeve attached to a first side of the umbrella member and extending from the umbrella perimeter radially toward the center of the umbrella member. The umbrella member and the towel members are securable together along their perimeters. The sectional umbrella support includes a two part vertical support pole including an umbrella spike having a diameter sized to pass through the umbrella spike aperture of the towel member, a central support having a first end adapted for connection with the vertical support pole and for horizontal support pole connecting members.

11 Claims, 2 Drawing Sheets

BEACH TOWEL, TOTE BAG AND BEACH UMBRELLA SYSTEM

TECHNICAL FIELD

The present invention relates to beach going accessories and more particularly to a beach towel, tote bag and beach umbrella system that can be used to carry items to and from a beach or other recreation site and used as both a beach towel and a beach umbrella while at the beach.

BACKGROUND OF THE INVENTION

Many people enjoy going to the beach to enjoy the sun, sand and surf. Although beach activities can be fun, carrying items to increase the enjoyment of the outing such as beach towels, sunscreen, radios, umbrellas, water and sand toys, etc. to and from the beach can be cumbersome. It would be a benefit, therefore, to have a beach towel that could be easily converted into a tote bag for carrying these items to and from the beach and which could be used as a beach towel while at the desired beach location. In addition, while many people enjoy the sunshine at the beach, many other people require or would enjoy a shaded area in which to enjoy beach activities. It would be a further benefit, therefore, if the beach towel could be converted into a beach umbrella when desired. It would of course be a further benefit, if the beach towel could be used as an umbrella and as a beach towel at the same time.

SUMMARY OF THE INVENTION

It is thus an object of the invention to provide a beach towel, tote bag and beach umbrella system.

It is a further object of the invention to provide a beach towel, tote bag and beach umbrella system that can be used as a beach towel and as a beach umbrella system at the same time.

It is a still further object of the invention to provide a beach towel, tote bag and beach umbrella system that accomplishes both of the above objects in combination.

Accordingly, a beach towel, tote bag and beach umbrella system is provided. The system includes a towel member having a towel perimeter edge defining a towel shape, a drawstring sleeve provided adjacent to the towel perimeter, a draw string having a first and second drawstring end positioned through the drawstring sleeve with the first and second drawstring ends extending out from the drawstring sleeve, at least one towel section of hook and pile fastener material secured to the towel member adjacent to and around the towel perimeter, and a centrally located umbrella spike aperture formed through the towel member; an umbrella member having an umbrella perimeter defining an umbrella shape corresponding to the towel shape in a manner such that the umbrella perimeter and the towel perimeter can be placed in registration, four elongated, tubular shaped, fabric, pole attachment sleeves open at both ends thereof, each pole attachment sleeve being attached to a first side of the umbrella member and extending from the umbrella perimeter radially toward the center of the umbrella member, and four umbrella sections of hook and pile fastener material complimentary to the hook and pile sections secured around the towel perimeter, each of the four umbrella sections of hook and pile material being secured adjacent to the umbrella perimeter and positioned between two of the pole attachment sleeves; and a sectional umbrella support including a two-part. vertical support pole having an umbrella spike sized to pass through the umbrella spike aperture of the towel member, a central support having a first end adapted for connection with the vertical support pole and four horizontal support pole connecting members, each horizontal support pole connecting member being oriented at an angle of ninety degrees with respect to the first end of the central support and an angle of about ninety degrees with respect to two of the other horizontal support pole connecting members.

In use the towel member perimeter and the umbrella member perimeter are placed into registration and the towel member and umbrella member secured together with the towel and umbrella sections of hook and pile material. When thus configured, the system can be used as a tote bag by positioning the items to be transported onto the center of the towel member and then pulling on the drawstring ends until the towel perimeter cinches closed forming a carrying compartment. Upon arrival at the beach or other location the towel perimeter is uncinched and the towel member and umbrella members separated by pulling the towel and umbrella sections of hook and pile material apart. The umbrella member is then set up by positioning the central support onto the center of the umbrella member with each of the four horizontal support pole connecting members aligned with an opening of one of the four horizontal support pole attachment sleeves, inserting a horizontal support pole through the perimeter opening of each of the horizontal support pole attachment sleeves and into connection with one of the horizontal support pole connecting members, connecting the vertical support pole to the first end of the central support, and inserting the umbrella spike of the vertical support pole through the umbrella spike aperture of the towel member into the sand or ground beneath the towel member a sufficient distance to support the vertical support pole in a substantially vertical position. With the umbrella member thus supported, the towel member can be used for lounging, sleeping, reading, etc.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
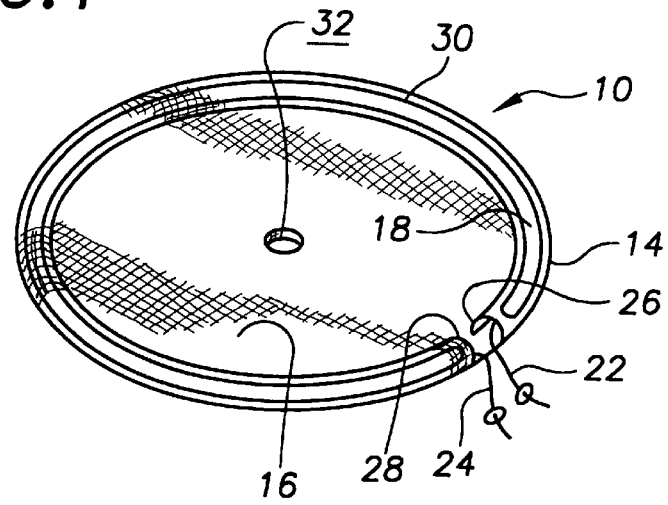
FIG. 1 is a perspective view of an exemplary embodiment of the towel member of the system of the present invention showing the two ends of the drawstring of the towel member extending outwardly from the drawstring sleeve provided adjacent to the perimeter of the towel member and the centrally positioned umbrella spike aperture through which the umbrella spike of the umbrella support of the system is inserted in use.
Figure 2:
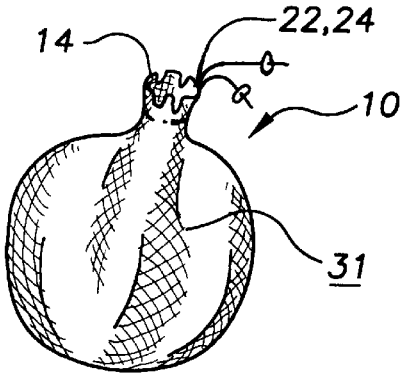
FIG. 2 is a side plan view showing the towel member configured in the tote bag configuration with the drawstring of the towel member cinched to form a carrying compartment.

FIG. 1 shows an exemplary embodiment a towel member, generally designated 10, of the system of the present invention. Towel member 10 has a towel perimeter 14 defining a circular shaped towel surface 16. In this embodiment, towel member 10 is constructed from terry cloth and has a diameter of seven feet. A drawstring sleeve 18 is provided around towel surface 16 and adjacent to towel perimeter 14. A draw string 20 having a first drawstring end 22 and a second drawstring end 24 is positioned through drawstring sleeve 18 with first and second drawstring ends 22, 24 extending out from drawstring sleeve 18 through sleeve apertures 26, 28. In this embodiment, draw string sleeve 18 is constructed by folding over a section of material and stitching. Drawstring 20 is a length of cotton cord. Referring to FIG. 2, a tote bag configuration is achieved with towel member 10 by pulling drawstring ends 22, 24 until towel perimeter 14 is cinched closed forming a tote compartment 31 defined by towel surface 16.

Referring back to FIG. 1, a length of hook and pile fastener material 30 is stitched to the surface of drawstring sleeve 18 along substantially the entire length thereof. In addition, towel member 10 has a centrally located umbrella spike aperture 32 formed through towel surface 16.

Figure 3:
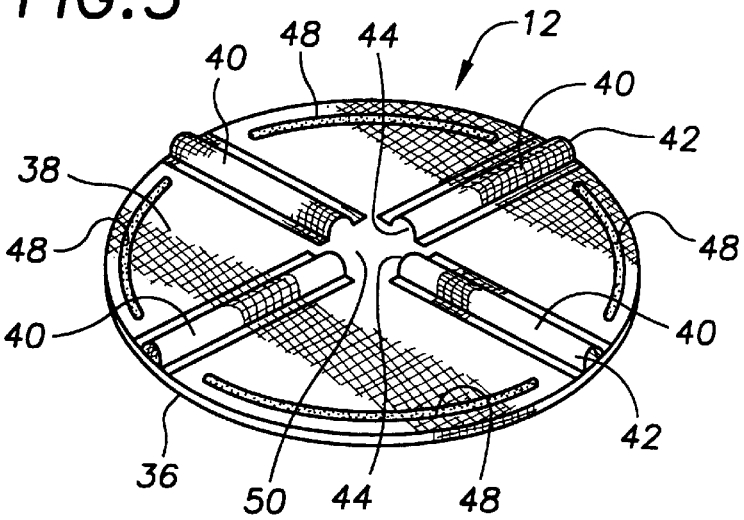
FIG. 3 is a perspective view of the pole attachment side of the umbrella member showing the four horizontal pole attachment sleeves oriented radially with respect to the open central support contact section of the umbrella member and the perimeter hook and pile sections used to secure the perimeter of the umbrella member to the towel member when the umbrella member is not in use.

FIG. 3 shows an exemplary embodiment of the umbrella member of the system of the present invention generally designated by the numeral 12. Umbrella member 12 has an umbrella perimeter 36 defining a circular shaped umbrella surface 38. Umbrella member 12 is also constructed from terry cloth and has a diameter of seven feet. Because towel member 10 and umbrella member 12 have the same size and shape, umbrella perimeter 14 and towel perimeter 36 can be placed in registration.

Umbrella member 12 includes four elongated, tubular shaped, terry cloth fabric, pole attachment sleeves 40 stitched to umbrella surface 38. Each pole attachment sleeve 40 is open at both ends 42, 44 thereof. Pole attachment sleeves 40 are spaced at ninety degree intervals, oriented radially from the center of umbrella surface 38 and each extend to umbrella perimeter 38 at one end thereof. A central contact surface 50 is defined in the center of umbrella surface 38 by the other ends of pole attachment sleeves 40. Four umbrella sections 48 of hook and pile fastener material complimentary to the hook and pile material 30 secured to drawstring sleeve 18 are each secured adjacent umbrella perimeter 38 and between two adjacent pole attachment sleeves 40.

Figure 4:
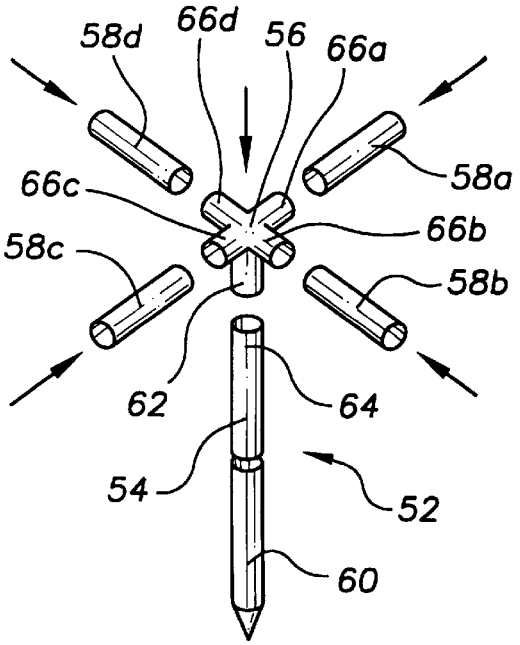
FIG. 4 is a partially exploded, perspective view of an exemplary embodiment of the umbrella support of the system showing the sectional vertical support pole including the umbrella spike, the central support, and the four horizontal support poles.
Figure 4A:
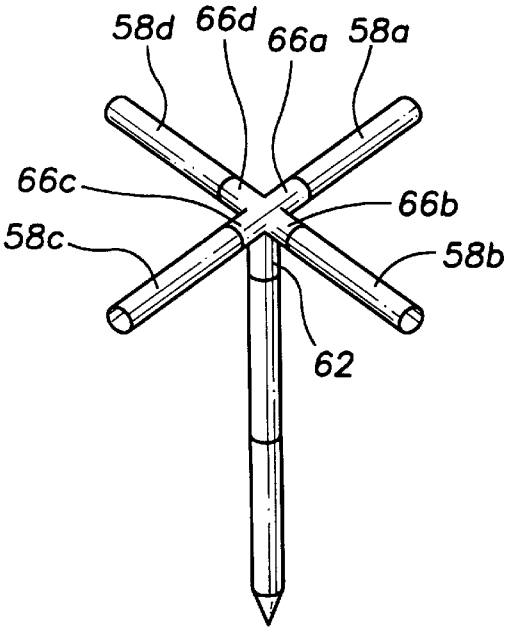
FIG. 4A is a perspective view of the umbrella support of FIG. 4 with the sectional vertical support pole and the four horizontal support poles secured to the central support.

FIG. 4 shows an exemplary sectional umbrella support of the system of the invention, generally designated by the numeral 52. Sectional umbrella support 52 includes a two-part vertical support pole 54, a central support 56, and four horizontal support poles 58*a–d*. Vertical support pole 54, central support 56, and horizontal support poles 58*a–d* are constructed from plastic tubing elements. Vertical support pole 54 includes an umbrella spike 60 at one end thereof having a diameter sized to pass through umbrella spike aperture 32 of towel member 10. Central support 56 has a first end 62 having an first internal bore sized to receive and frictionally hold a second end 64 of vertical support pole 54 therein, and four horizontal support pole connecting members 66*a–d*. Each horizontal support pole connecting member 66*a–d* is provided with an internal bore sized to receive and frictionally hold an end of a horizontal support pole 58*a–d*. FIG. 4A shows horizontal support poles 58*a–d* in connection with horizontal pole connecting members 66*a–d* and vertical support shaft in connection with first end 62.

Figure 5:
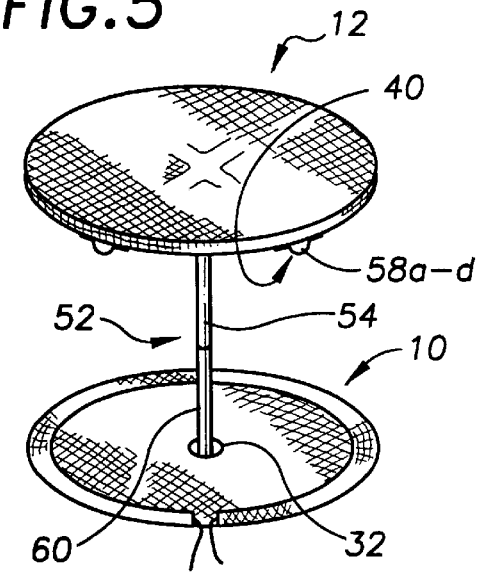
FIG. 5 is a perspective view of the exemplary system of the invention showing the umbrella member supported by the umbrella support with the horizontal support poles inserted through the pole attachment sleeves into connection with the central support and the umbrella spike of the vertical support pole inserted through the umbrella spike aperture of the beach towel member.

FIG. 5 shows towel member 10, umbrella member 12 and umbrella support 52 in use. As shown in the figure, umbrella member 12 is supported by umbrella support 52 by inserting horizontal support poles 58*a–d* through pole attachment sleeves 40 and into connection with central support 56 (FIG. 4) as previously described. Central support 56 is then connected to vertical support pole 54 and umbrella spike 60 inserted through umbrella spike aperture 32 of towel member 10 into the ground or sand. Umbrella member 12 is now securely positioned above towel member 10 to provide screening from the sun to people seated or laying on towel member 10. The system is disassembled by simply reversing the steps previously discussed.

It can be seen from the preceding description that a beach towel, tote bag and beach umbrella system has been provided that can be used as a beach towel and as a beach umbrella system at the same time.

It is noted that the embodiment of the beach towel, tote bag and beach umbrella system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A beach towel, tote bag and beach umbrella system comprising:

a towel member having a towel perimeter edge defining a circular towel shape, a drawstring sleeve provided adjacent to said towel perimeter, a draw string having a first and second drawstring end positioned through said drawstring sleeve with said first and second drawstring ends extending out from said drawstring sleeve, at least one towel section of hook and pile fastener material secured to said towel member adjacent to and around said towel perimeter, and a centrally located umbrella spike aperture formed through said towel member;

an umbrella member having an umbrella perimeter defining an umbrella shape corresponding to said towel shape in a manner such that said umbrella perimeter and said towel perimeter can be placed in registration, four elongated, tubular shaped, fabric, pole attachment sleeves open at both ends thereof, each pole attachment sleeve being attached to a first side of said umbrella member and extending from said umbrella perimeter radially toward a center of said umbrella member and four umbrella sections of hook and pile fastener material complimentary to said hook and pile sections secured around said towel perimeter, each of said four umbrella sections of hook and pile material being secured adjacent to said umbrella perimeter and positioned between two of said pole attachment sleeves; and a sectional umbrella support including a two-part vertical support pole having an umbrella spike sized to pass through said umbrella spike aperture of said towel member, a central support having a first end adapted for connection with said vertical support pole and four horizontal support pole connecting members, each horizontal support pole connecting member being oriented at an angle of ninety degrees with respect to said first end of said central support and an angle of about ninety degrees with respect to two of said other horizontal support pole connecting members.

2. The beach towel, tote bag and beach umbrella system of claim 1, wherein:

said towel member and said umbrella member are circular shaped.

3. The beach towel, tote bag and beach umbrella system of claim 1, wherein:

said sectional umbrella support is constructed from plastic tubing elements.

4. The beach towel, tote bag and beach umbrella system of claim 1 wherein:

said towel member is constructed from terry cloth.

5. The beach towel, tote bag and beach umbrella system of claim 1 wherein:

said umbrella member is constructed from terry cloth.

6. The beach towel, tote bag and beach umbrella system of claim 2, wherein:

said sectional umbrella support is constructed from plastic tubing elements.

7. The beach towel, tote bag and beach umbrella system of claim 2 wherein:

said towel member is constructed from terry cloth.

8. The beach towel, tote bag and beach umbrella system of claim 2 wherein:

said umbrella member is constructed from terry cloth.

9. The beach towel, tote bag and beach umbrella system of claim 6 wherein:

said towel member is constructed from terry cloth.

10. The beach towel, tote bag and beach umbrella system of claim 6 wherein:

said umbrella member is constructed from terry cloth.

11. The beach towel, tote bag and beach umbrella system of claim 9 wherein:

said umbrella member is constructed from terry cloth.

* * * * *